US005970273A

United States Patent [19]

Zenk et al.

[11] Patent Number: 5,970,273

[45] Date of Patent: Oct. 19, 1999

[54] INK CARTRIDGE FOR LIQUID ELECTROGRAPHIC IMAGING DEVICES

[75] Inventors: James E. Zenk, St. Paul; Mark A. Sanner, Forest Lake; H. Chris Gydesen, Oakdale; Russell A. Roiko, Rogers, all of Minn.; Kay F. Schilli, Portland, Oreg.

[73] Assignee: Imation Corp., Oakdale, Minn.

[21] Appl. No.: 09/111,228

[22] Filed: Jul. 7, 1998

[51] Int. Cl.[6] ..... G03G 15/10; G03G 15/01

[52] U.S. Cl. ..... 399/12; 399/233; 399/238

[58] Field of Search ..... 399/57, 233, 237, 399/238, 239, 240, 12, 224; 222/DIG. 1

[56] References Cited

U.S. PATENT DOCUMENTS

| | | | |
|---|---|---|---|
| 3,411,936 | 11/1968 | Roteman | 117/37 |
| 3,832,170 | 8/1974 | Nagamatsa et al. | 96/1.2 |
| 3,876,282 | 4/1975 | Schon et al. | 355/10 |
| 3,973,699 | 8/1976 | Cook | 222/108 |
| 4,193,683 | 3/1980 | Langner | 355/10 |
| 4,222,497 | 9/1980 | Lloyd et al. | 222/57 |
| 4,310,238 | 1/1982 | Mochizuki et al. | 355/14 |
| 4,578,331 | 3/1986 | Ikeda et al. | 430/42 |
| 4,728,983 | 3/1988 | Zwadlo et al. | 355/4 |
| 4,877,698 | 10/1989 | Watson et al. | 430/45 |
| 4,886,730 | 12/1989 | Ota et al. | 430/137 |
| 5,078,504 | 1/1992 | Landa et al. | 366/118 |
| 5,083,165 | 1/1992 | Landa | 355/256 |
| 5,142,334 | 8/1992 | Iemura et al. | 399/237 |
| 5,153,659 | 10/1992 | Maiefski et al. | 355/256 |
| 5,208,637 | 5/1993 | Landa | 355/256 |
| 5,293,913 | 3/1994 | Preszler | 141/367 |
| 5,294,891 | 3/1994 | Saklikar et al. | 324/705 |
| 5,300,990 | 4/1994 | Thompson | 355/256 |
| 5,345,296 | 9/1994 | Wellings | 355/256 |
| 5,396,316 | 3/1995 | Smith | 355/256 |
| 5,420,675 | 5/1995 | Thompson et al. | 355/256 |
| 5,435,461 | 7/1995 | Smith et al. | 222/45 |
| 5,447,056 | 9/1995 | Foote | 73/61.71 |
| 5,461,466 | 10/1995 | Girard et al. | 355/256 |
| 5,539,503 | 7/1996 | Johnson | 355/256 |
| 5,546,984 | 8/1996 | Arcaro | 137/614.03 |
| 5,552,869 | 9/1996 | Schilli et al. | 355/256 |
| 5,576,815 | 11/1996 | Treschendorf et al. | 355/256 |
| 5,596,398 | 1/1997 | Woo et al. | 399/346 |
| 5,650,253 | 7/1997 | Baker et al. | 430/119 |
| 5,652,282 | 7/1997 | Baker et al. | 523/201 |
| 5,655,194 | 8/1997 | Landa et al. | 399/238 |
| 5,666,586 | 9/1997 | Nishimura et al. | 399/13 |
| 5,694,278 | 12/1997 | Sumner | 360/133 |
| 5,698,616 | 12/1997 | Baker et al. | 523/201 |
| 5,713,068 | 1/1998 | Teschendorf et al. | 399/249 |
| 5,754,928 | 5/1998 | Moe et al. | 399/249 |

FOREIGN PATENT DOCUMENTS

| | | |
|---|---|---|
| 0 306 217 | 3/1989 | European Pat. Off. . |
| 0 685 769 | 12/1995 | European Pat. Off. . |
| WO 92/17824 | 10/1992 | WIPO . |
| WO 94/01756 | 1/1994 | WIPO . |
| WO 94/01809 | 1/1994 | WIPO . |

*Primary Examiner*—Joan Pendegrass
*Attorney, Agent, or Firm*—William D. Bauer

[57] ABSTRACT

An ink cartridge for use in an ink replenishment system in an electrographic imaging device. The removable ink cartridge is configured to engage with a cartridge interface assembly and a detector in an ink cartridge bay on an electrographic imaging device. The ink cartridge has an outer shell comprising at least a first compartment containing a liquid ink and a second compartment. A first valve is fluidly coupled to the first compartment. Second and third valves are fluidly coupled to the second compartment. The first, second, and third valves are adapted to engage with corresponding valves at the cartridge interface assembly. A plurality of key slots are provided for receiving one or more key tabs that identify the ink cartridge. The key tabs are positioned to engage with the detector in the ink cartridge bay. A cap for an ink cartridge is also disclosed.

34 Claims, 10 Drawing Sheets

INK CARTRIDGE FOR LIQUID ELECTROGRAPHIC IMAGING DEVICES

FIELD OF THE INVENTION

The present invention relates generally to an ink cartridge for a liquid electrographic imaging device. The present invention is also directed to a cap for an ink cartridge.

BACKGROUND OF THE INVENTION

A liquid electrographic imaging system includes an imaging substrate onto which a developer liquid is delivered to develop a latent image. The imaging substrate may be a permanent image receptor or alternatively, may be a temporary image receptor. A liquid electrographic imaging system may be an electrostatic system having a dielectric material as the imaging substrate, or may take the form of an electrophotographic system having a photoreceptor as the imaging substrate. In an electrostatic system that makes use of a dielectric material, the latent image can be formed by selectively charging the dielectric substrate with an electrostatic stylus. In an electrophotographic system, the photoreceptor includes a photoconductive material that is uniformly charged, for example, with a corona charging device. A latent image can be formed on the photoreceptor by selectively discharging the photoreceptor with a pattern of radiation. A liquid electrophotographic imaging system with a photoreceptor will be discussed for purposes of example.

Several techniques have been developed over the years to adapt electrographic techniques to use multiple colors, such as disclosed in U.S. Pat. Nos. 3,832,170 (Nagamatsu et al.); 4,578,331 (Ikeda et al.); 4,728,983 (Zwadlo et al.); and 4,877,698 (Watson et al.). Color printers use three primary colors, typically cyan, magenta and yellow, and in addition, optionally, black. The toner may be a dry powder or a liquid.

The liquid ink (also referred to as a liquid toner or liquid developer) for an electrophotographic printing system normally includes solids or toner particles dispersed in a liquid carrier or solvent at a predetermined ratio. These two components deplete at different rates from the ink during printing. The relative component depletion rates are dependent on the percent coverage of the image produced by the imaging system and on other factors. For example, as the solids get transferred to the receptor material, the ratio of liquid carrier to solids increases, necessitating the addition of more solids to the ink. In images where the percent coverage is relatively low, liquid carrier is lost from the receptor material at a rate faster than the solids are depleted from the ink, requiring additional liquid carrier to be added to the ink to maintain the required ratio of solids to liquid carrier. Various systems have been made to deliver ink solids and liquid carrier to electrophotographic printers.

U.S. Pat. No. 5,208,637 (Landa) discloses a liquid toner replenishment system for an electrophotographic printer that does not have a separate liquid carrier replenishment system. When the density of the liquid toner in the mixing reservoir is below a first predetermined level, a motor is activated to add a measured amount of toner concentrate from a container to the respective toner reservoir, thereby increasing the toner particle concentration to the required level. Since the proportion of toner particles to liquid carrier in the container is less than the concentration carried out of the toner reservoir, an excess of liquid carrier is effectively added to the reservoir in excess of that removed by printing. This process causes the liquid level in the tank to rise slightly each time the toner concentrate is added. No mechanism is provided for adding liquid carrier to the reservoirs in the event the concentration of toner particles exceeds a predetermined level.

U.S. Pat. No. 3,973,699 (Cook) discloses a liquid dispensing apparatus utilizing a double-acting piston. When the level of liquid developer drops to a predetermined level, a drive unit is energized and the liquid developer is forced from the cartridge. The pressure drop caused by movement of the piston is employed to draw waste developer from a sump into a chamber within the cartridge. The liquid dispensing apparatus of Cook does not provide separate sources of ink concentrate or liquid carrier in order to maintain the required ratio of those components in the developer tray.

U.S. Pat. No. 3,876,282 (Schon et al.) discloses a container for supplying liquid developer in an electrophotographic copier. The container of Schon holds both developer concentrate and developer separated by a sliding separating wall. Developer concentrate is displaced into the correspondingly enlarged liquid developer chamber by movement of the sliding separating wall. Although the concentration of the liquid developer can be increased by the addition of developer concentrate, the container of Schon does not provide a source of liquid carrier to lower the concentration of the liquid developer when necessary.

BRIEF SUMMARY OF THE INVENTION

The present invention is directed to an ink cartridge for use in an ink replenishment system in an electrographic imaging device. In a first embodiment, the removable ink cartridge is configured to engage with a cartridge interface assembly and a detector in an ink cartridge bay on an electrographic imaging device. The ink cartridge has an outer shell comprising at least a first compartment containing a liquid ink and a second compartment. A first self-sealing valve is fluidly coupled to the first compartment. Second and third self-sealing valves are fluidly coupled to the second compartment. The first, second, and third valves are adapted to engage with corresponding self-sealing valves at the cartridge interface assembly. A plurality of key slots are provided for receiving one or more key tabs that identify the ink cartridge. The key tabs are positioned to engage with the detector in the ink cartridge bay.

In one embodiment, the outer shell has an asymmetrical cross section corresponding to a cross section of the ink cartridge bay. In another embodiment, the relative size of the first and second compartments change dynamically. The first compartment can be a flexible container. The liquid ink can be working solution or ink concentrate. The second compartment can contain a fluid selected from the group consisting of liquid carrier, working solution, and charge director. In one embodiment, the second compartment is the working solution reservoir.

In one embodiment, a valve access door extends across the selfsealing valves in a closed position. The valve access door is rotatable to an open position in response to engagement of the ink cartridge with the cartridge interface assembly. The valve access door may include a latch for retaining the valve access door in the closed position.

Key slots may be located on the outer shell or a cap extending across the self-sealing valves. Key tabs engaged with the slots can identify a color of the liquid ink, a concentration of the liquid ink, and alignment of the liquid ink cartridge within the cartridge interface assembly. In another embodiment, the key tabs are a data storage device. The data storage device can include data selected from a group consisting of color of the ink concentrate, concentration of the ink concentrate to liquid carrier, date the ink cartridge was manufactured, remaining life of the ink cartridge, number of prints made from the cartridge, and manufacturer identification codes.

In another embodiment, the ink cartridges comprise three compartments. The third compartment can initially be empty or contain a liquid carrier. The sizes of at least two of the compartments preferably change dynamically.

The ink cartridge preferably includes at least one sensor for monitoring a concentration and/or level of the working solution. The ink cartridge can be oriented generally horizontal or vertical within the electrographic imaging device. In one embodiment, the ink cartridge includes an impeller for agitation located within the first compartment adapted to magnetically couple with an actuator in the cartridge interface assembly.

The present invention is also directed to a removable ink cartridge for an ink replenishment system adapted to engage with a cartridge interface assembly in an ink cartridge bay on an electrographic imaging device. The removable ink cartridge comprising an outer shell having at least a first compartment containing a liquid ink and a second compartment containing liquid carrier. A first self-sealing valve is fluidly coupled to the first compartment. A second self-sealing valve is fluidly coupled to the second compartment. The first and second valves are adapted to engage with corresponding self-sealing valves at the cartridge interface assembly.

The present invention is also directed to a cap for a removable ink cartridge used in an ink replenishment system. The ink cartridge is adapted to engage with a cartridge interface assembly in an ink cartridge bay on an electrographic imaging device. The removable ink cartridge has at least a first compartment containing a liquid ink fluidly coupled to a first self-sealing valve and a second compartment fluidly coupled to the second compartment. The cap includes a cap structure having a first opening for accessing the first valve and a second opening for accessing the second valve. The cap structure is adapted to extend over an end of the ink cartridge. A plurality of key slots for receiving one or more key tabs that identify the ink cartridge are located on the cap structure. The key tabs are positioned to engage with a corresponding detector in the ink cartridge bay.

In one embodiment, an impeller is located within the first compartment adapted to couple to an actuator at the cartridge interface assembly. The cap structure includes an opening for coupling the impeller to the actuator. In another embodiment, a valve access door extends across the first and second openings in a closed position. The valve access door is rotatable to an open position in response to engagement of the ink cartridge with the cartridge interface assembly. The valve access door can include a latch for retaining the valve access door in the closed position.

As used here;

"liquid carrier" refers to a solvent or other liquid into which the film-forming solids or film-forming toner particles are dispersed.

"concentration" refers to the ratio of ink solids in a volume of liquid ink.

"electrographic" refers to electrostatic, electrophotographic and ionographic.

"imaging device" refers to printers, copiers, fax machines, and other image duplication systems.

"ink solids" refers to film-forming solids or film-forming toner particles.

"ink" or "liquid ink" refers to ink solids dispersed in a liquid carrier.

"ink concentrate" refers to ink at a concentration greater than the working solution concentration.

"ink replenishment system" refers to a method and apparatus that permits the concentration of the working solution to be either increased or decreased.

"printed down ink" or "depleted ink" refers to ink at a concentration of ink solids below the working solution concentration.

"photoreceptor material" refers to electrophotographic imaging materials onto which a film forming ink can be deposited.

"substantially dry ink" refers to ink on a receptor material with about 50 volume % solids or greater.

"working solution" refers to ink at about the working solution concentration.

"working solution concentration" refers to a concentration of ink solids suitable for developing a latent image on a receptor material in an electrographic imaging device.

BRIEF DESCRIPTION OF THE SEVERAL VIEW OF THE DRAWINGS

The foregoing advantages, construction and operation of the present invention will become more readily apparent from the following description and accompanying drawings in which.

DETAILED DESCRIPTION OF THE INVENTION

Liquid electrophotography is a technology that produces or reproduces an image on paper or other desired receiving medium. Liquid electrophotography uses liquid inks that may be black or which may be of different colors for the purpose of plating solid material onto a surface in a well controlled and image-wise manner to create the desired prints. Typically, liquid inks used in electrophotography are substantially transparent or translucent to radiation emitted at the wavelength of the latent image generation device so that multiple image planes can be laid over one another to produce a multi-colored image constructed of a plurality of image planes with each image plane being constructed with a liquid ink of a particular color.

Typically, a colored image is constructed of four image planes. The first three planes are constructed with a liquid ink in each of the three subtractive primary printing colors, yellow, cyan, and magenta. The fourth image plane uses a black ink that need not be transparent to radiation emitted at the wavelength of the latent image generation device. Various methods and devices for electrophotographic printing are disclosed U.S. Pat. No. 5,650,253 (Baker et al.) entitled Method and Apparatus having Improved Image Transfer Characteristics for Producing an Image on Receptor Medium such as Plain Paper.

In the illustrated embodiment, the process involved in liquid electrophotography can be illustrated with reference to FIGS. 1 and 2. Light sensitive, photoreceptor material 10 is arranged on or near the surface of a mechanical carrier, such as drum 12. Drum 12 rotates in the clockwise direction of FIG. 1 moving a given location of photoreceptor material 10 past various stationary components which perform an operation relative to photoreceptor material 10 or an image formed on drum 12. Alternatively, the photoreceptor material 10 can be a belt structure.

Figure 1:
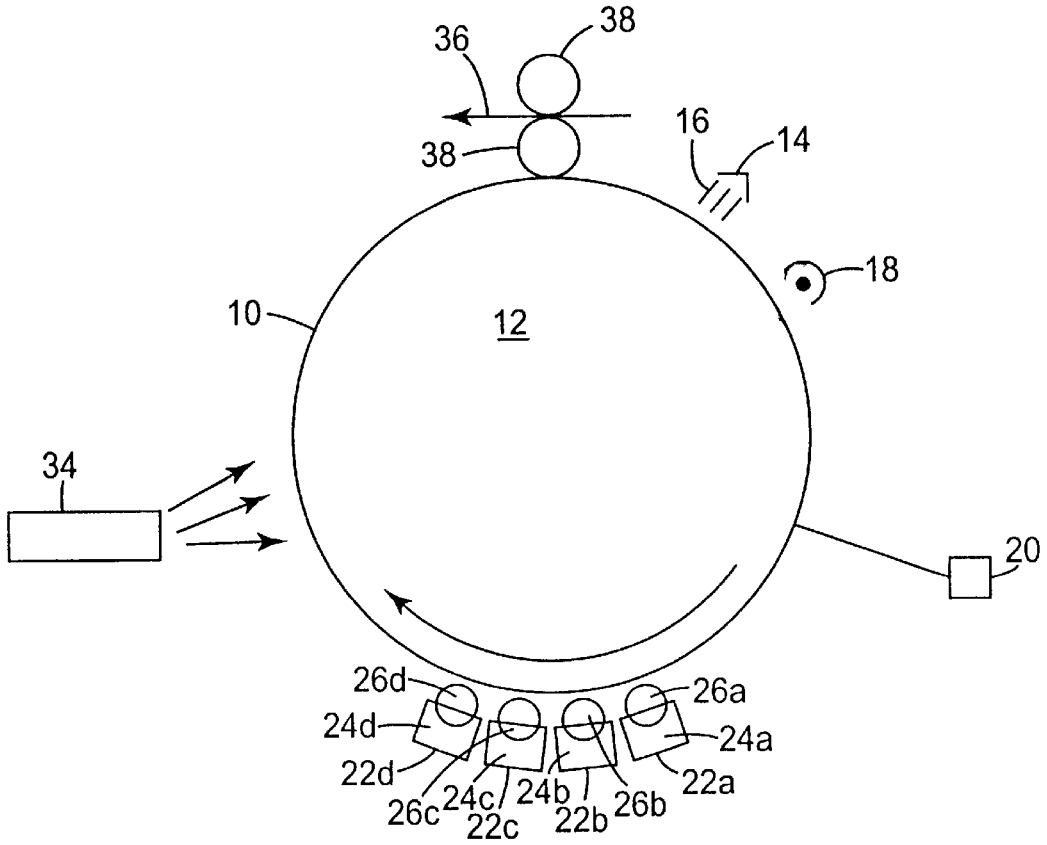
FIG. 1 is a diagrammatic illustration of an electrophotographic method and apparatus.

In FIG. 1, as drum 12 rotates, photoreceptor material 10 moves past erase lamp 14. When photoreceptor material 10 passes under erase lamp 14, radiation 16 from erase lamp 14 impinges on the surface of photoreceptor material 10 causing any residual charge remaining on the surface of photoreceptor material 10 to "bleed" away. Thus, the surface charge distribution of the surface of photoreceptor material 10 as it exits erase lamp 14 is quite uniform and nearly zero depending upon the photoreceptor.

As drum 12 continues to rotate and photoreceptor material 10 next passes under charging device 18, a uniform positive or negative charge is imposed upon the surface of photoreceptor material 10. In a preferred embodiment, the charging device 18 is a positive DC corona. Typically, the surface of photoreceptor material 10 is uniformly charged to around 600 volts depending on the capacitance of photoreceptor. Charging prepares the surface of photoreceptor material 10 for an image-wise exposure to radiation by laser scanning device 20 as drum 12 continues to rotate.

Wherever radiation from laser scanning device 20 impinges on the surface of photoreceptor material 10, the surface charge of photoreceptor material 10 is reduced significantly while areas on the surface of photoreceptor material 10 which do not receive radiation are not appreciably discharged. Areas of the surface of photoreceptor material 10 which receive some radiation are discharged to a degree that corresponds to the amount of radiation received. This results in the surface of photoreceptor material 10 having a surface charge distribution which is proportional to the desired image information imparted by laser scanning device 20 when the surface of photoreceptor material 10 exits from under laser scanning device 20. As drum 12 continues to rotate, the surface of photoreceptor material 10 engages with one of the developer stations 22*a*, 22*b*, 22*c*, 22*d*, each corresponding to a primary color (i.e., yellow, magenta, cyan) and optionally black.

Figure 2:
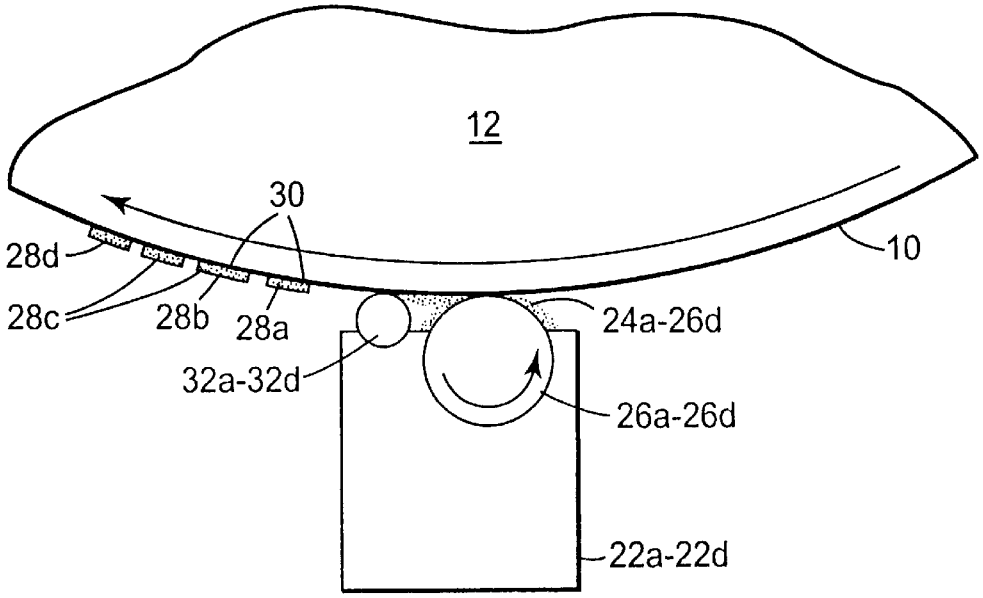
FIG. 2 is an expanded diagrammatic illustration of a single developer station used in the apparatus illustrated in FIG. 1.

The operation of individual developer stations 22*a*, 22*b*, 22*c*, 22*d* can be more readily understood by reference to FIG. 2. The first color plane is developed by bringing the developer station 22*a* into position adjacent to the photoreceptor material 10. The other three developer stations 22*b*, 22*c*, 22*d* preferably do not engage with the photoreceptor during development of the first color plane. Ink 24*a* is applied to the surface of image-wise charged photoreceptor material 10 in the presence of an electric field which is established by placing development roll 26*a*, illustrated as a roller, near the surface of photoreceptor material 10 and imposing a bias voltage on development roll 26*a*. Ink 24*a* consists of positively charged "solid," but not necessarily opaque, toner particles of the desired color for this portion of the image being printed. The "solid" material in the liquid ink, under force from the established electric field, migrates to and plates upon the surface of photoreceptor material 10 in areas 28*a* where the surface voltage is less than the bias voltage of development roll 26*a*. The "solid" material in the liquid ink will migrate to and plate upon the development roll in areas 30 where surface voltage of photoreceptor material 10 is greater than the bias voltage of development roll 26*a*. Excess ink not sufficiently plated to either the surface of photoreceptor material 10 or to development roll 26*a* is returned to the developer station 22*a*. The method for removing excess ink in the illustrated embodiment is a "crowned squeegee roller" described in U.S. Patent Application entitled Squeegee Apparatus and Method for Removing Developer Liquid From an Imaging Substrate and Fabrication Method, U.S. Ser. No. 08/811,660 filed Mar. 4, 1997.

The ink 24*a* is dried by drying mechanism 32*a* which may include a roll, vacuum box or curing station. Drying mechanism 32*a* substantially transforms ink 24*a* into a substantially dry film 28*a*. The excess ink 24*a* returns to developer station 22*a* for subsequent processing. The "solid" portion 28*a* (film) of ink 24*a* plated upon the surface of photoreceptor material 10 matches the image-wise charge distribution previously placed upon the surface of photoreceptor material 10 by laser scanning device 20 and, hence, is an image-wise representation of the desired image to be printed.

Film 28*a* is further dried by drying mechanism 34. Drying mechanism 34 may be a passive device, using for example active air blowers, heater, vacuum, coronas, or may be other active devices such as rollers. In a preferred embodiment, drying mechanism 34 is a drying roll or image conditioning roller, such as described in U.S. Pat. Nos. 5,420,675 and 5,552,869. The process is then repeated for developer stations 22*b*, 22*c*, 22*d* to deposit an image plane or film 28*b*, 28*c*, 28*d* of the other colors.

The film 28*a*, 28*b*, 28*c*, 28*d* representing the desired image to be printed is then transferred, either directly to the receiving medium 36 to be printed, or preferably and as illustrated in FIG. 1, indirectly by way of transfer rollers 38. Transfer is effected by differential tack of film 28*a*, 28*b*, 28*c*, 28*d* and transfer rollers 38. The preferred mechanism for image transfer is disclosed in U.S. Pat. No. 5,650,253 entitled Method and Apparatus Having Improved Image Transfer Characteristics for Producing an Image On a Receptor Medium such as Plain Paper. Typically, heat and pressure are utilized to fuse the image to medium 36. The resultant "print" is a full color hard copy manifestation of the image information written by laser scanning device 22, the colors represented by inks 24*a*, 24*b*, 24*c*, 24*d*.

In one embodiment, the drying mechanisms 32*a*, 32*b*, 32*c*, 32*d* are squeegee rolls described in U.S. patent application Ser. No. 08/811,660 entitled Apparatus and Method for Removing Developer Liquid from an Imaging Substrate and Fabrication Method, filed Mar. 4, 1997. Development rolls (also known as electrodes) 26*a*, 26*b*, 26*c*, 26*d* are kept clean by a developer cleaning roller as described in U.S. Pat. No. 5,596,398 entitled Apparatus and Method for Cleaning Developer From an Imaging Substrate. Any further excess ink is removed by an additional roller described in U.S. Pat. No. 5,713,068, entitled Apparatus and Method for Removing Excess Ink from a Imaging Substrate. An exemplary developer apparatus is described in detail in U.S. Pat. No. 5,576,815. Developer stations 22*a*, 22*b*, 22*c*, 22*d* are similar to that described in U.S. Pat. No. 5,300,990 (Thompson et al.).

Two-Compartment Ink Cartridge

Figure 3:
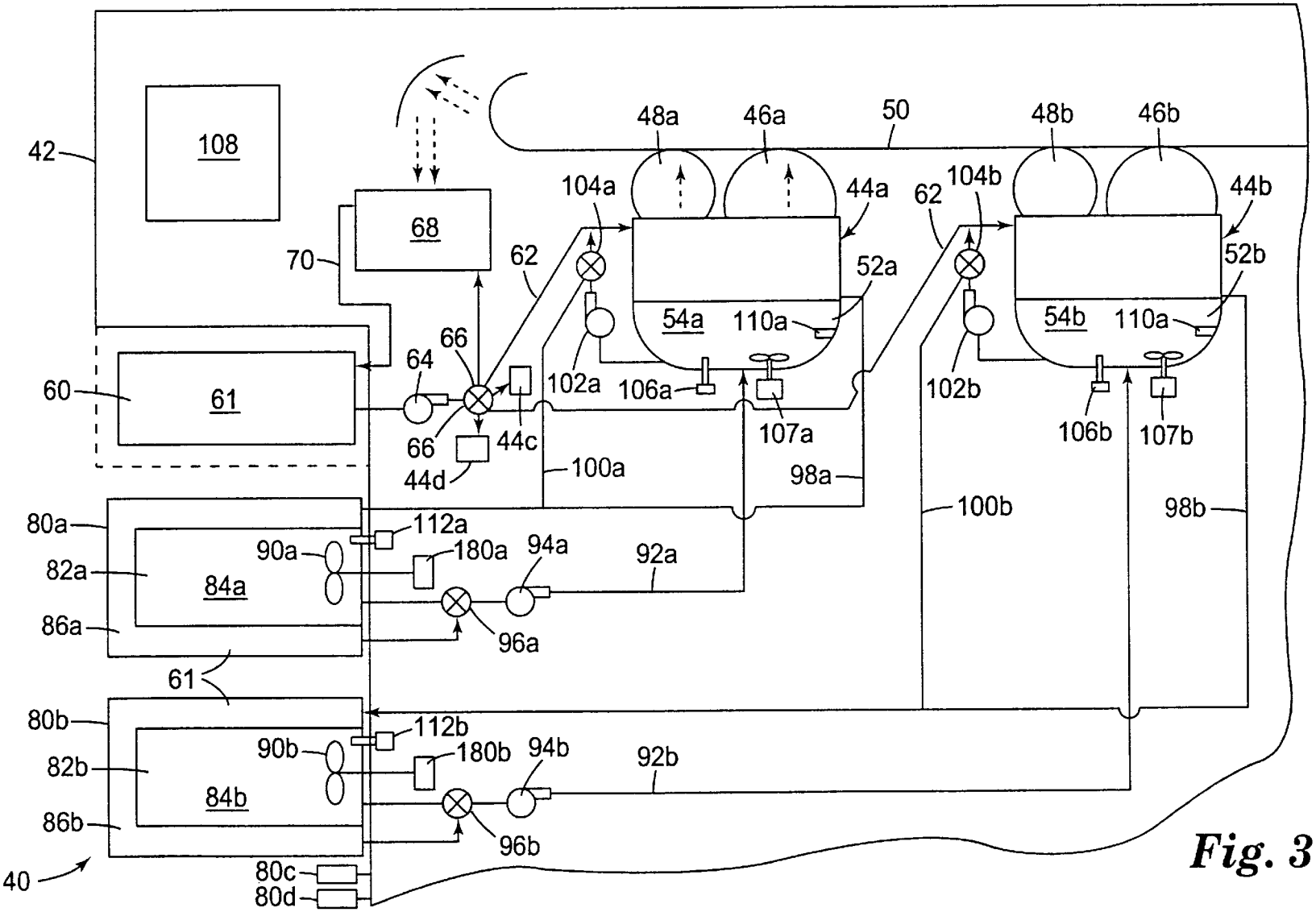
FIG. 3 is a schematic illustration of an ink replenishment system utilizing a two compartment ink cartridge for an electrographic imaging device in accordance with the present invention.

FIG. 3 is a schematic illustration of a liquid replenishment system 40 for an electrographic imaging device 42 having a plurality of developer stations 44*a*, 44*b*, 44*c*, 44*d*. The developer stations 44*c* and 44*d* are not shown in detail for the sake of simplicity. The components and operation of the developer stations 44*c*, 44*d* are substantially as described in connection with developer stations 44*a*, 44*b*. It will be understood that the liquid ink handling system for each developer station is preferably separate and complete, although the liquid carrier 61 is preferably supplied to each developer station from a single liquid carrier cartridge or container 60.

Developer stations 44*a*, 44*b* each have development rolls 46*a*, 46*b* and drying mechanisms 48*a*, 48*b* positioned opposite a photoreceptor material 50.

In the embodiment illustrated in FIG. 3, the photoreceptor material 50 is in the form of a continuous belt, rather than the drum illustrated in FIGS. 1 and 2. In the described embodiment, the developer stations 44*a*, 44*b* each have associated working solution reservoirs 52*a*, 52*b* for retaining respective working solutions 54*a*, 54*b*. The reservoirs 52*a*, 52*b* can either be part of the developer stations 44*a*, 44*b* or separate components.

A liquid carrier cartridge 60 is fluidly coupled to the developer stations 44*a*, 44*b* by a solvent supply line 62 and a solvent supply pump 64. Liquid carrier 61 can be directed to each of the developer stations 44*a*, 44*b* (44*c*, 44*d*) and a condenser 68 by the solenoid valve 66. Condenser 68 is positioned to recover evaporated liquid carrier 61 lost within the electrographic imaging device 42. A condenser return line 70 fluidly couples the condenser 68 to the liquid carrier cartridge 60. Alternatively, liquid carrier collected in the condenser 68 can be collected and removed from the electrographic imaging device 42. Cartridge 60 can either be permanently incorporated into the electrographic imaging device 42 or can be a removable cartridge, such as ink cartridges 80*a*, 80*b*.

FIG. 3 illustrates ink cartridges 80*a*, 80*b*, 80*c*, 80*d* coupled to respective developer stations 44*a*, 44*b* (44*c*, 44*d* not shown). Since ink cartridges 80*c*, 80*d* are shown schematically, the discussion will focus on ink cartridges 80*a*, 80*b*. The ink cartridges 80*a*, 80*b*, 80*c*, 80*d* may contain different color inks, inks of the same color, but at different concentrations or with different levels of charge carriers, or combinations thereof.

Ink cartridges 80*a*, 80*b* each have a first compartment 82*a*, 82*b* containing ink concentrate 84*a*, 84*b* and a second compartment 86*a*, 86*b* containing liquid carrier 61. Although FIG. 3 shows the cartridges in a horizontal configuration, it is possible to orient them vertically or on an angle. Agitators 90*a*, 90*b* are preferably provided in each of the first compartments 82*a*, 82*b*. Drive mechanisms 180*a*, 180*b*, such as a motor, are preferably positioned on the electrographic imaging device 42 to releasably couple to the agitators 90*a*, 90*b* (see generally FIG. 13).

The first compartments 82*a*, 82*b* and second compartments 86*a*, 86*b* are fluidly coupled to the working solution reservoir 52*a*, 52*b* by separate ink/carrier supply lines 92*a*, 92*b* and pumps 94*a*, 94*b*. Solenoid valves 96*a*, 96*b* are provided for selectively delivering concentrate 84*a*, 84*b* or liquid carrier 61 to the working solution reservoirs 52*a*, 52*b*. Valves 104*a*, 104*b* can alternatively direct the working solutions 54*a*, 54*b* to the second compartments 86*a*, 86*b* of the ink cartridges 80*a*, 80*b* or to the development rolls 46*a*, 46*b* on the developer stations 44*a*, 44*b*, respectively.

Overflow lines 98*a*, 98*b* fluidly couple the working solution reservoirs 52*a*, 52*b* to the second compartments 86*a*, 86*b* of the respective cartridges 80*a*, 80*b*. Return lines 100*a*, 100*b* and working solution pumps 102*a*, 102*b* fluidly couple the working solution reservoirs 52*a*, 52*b* to the second compartments 86*a*, 86*b*. As used herein, the various components of the return system direct both overflow and printed down ink from each of the working solution reservoirs 52*a*, 52*b* to the second compartments 86*a*, 86*b* of the respective ink cartridges 80*a*, 80*b*. Alternatively, the working solutions 54*a*, 54*b* can gravity drain into the second compartments 86*a*, 86*b*.

In one embodiment, the liquid carrier 61 in the second compartments 86*a*, 86*b* is mixed with a portion of the ink concentrates 84*a*, 84*b* in the respective first compartments 82*a*, 82*b* to form initial working solution 54*a*, 54*b* in the working solution reservoirs 52*a*, 52*b*. Once the liquid carrier 61 is removed from the second compartments 86*a*, 86*b*, the second compartments 86*a*, 86*b* are available for receiving fluids from the overflow lines 98*a*, 98*b* or the return lines 100*a*, 100*b*. In alternate embodiments, the second compartments 86*a*, 86*b* may be manufactured to be either initially empty or filled with a working solution 54*a*, 54*b*. The relative size of the first and second compartments 82*a*, 86*a* and 82*b*, 86*b* preferably changes dynamically to accommodate decreasing volumes of ink concentrate 84*a*, 84*b* and increasing volumes of printed down ink from the overflow lines 98*a*, 98*b* or return lines 100*a*, 100*b* (see FIGS. 4–7).

During printing, pumps 102*a*, 102*b* supply working solution 54*a*, 54*b* to the development rolls 46*a*, 46*b*. In the illustrated embodiment, sensors 106*a*, 106*b* monitor the concentration of ink solids in the working solutions 54*a*, 54*b*. Concentration of ink solids can be measured by evaluating by a variety of properties, such as magnetic or optical properties, or the conductivity of the working solutions 54*a*, 54*b*. Alternate sensors can monitor the optical density on the photoreceptor 50 or the optical density on the receiving medium 36 (see FIG. 1). Liquid level sensors 110*a*, 110*b* optionally monitor the level of working solution 54*a*, 54*b* in the reservoirs 52*a*, 52*b*. Sensors 112*a*, 112*b* may optionally be included in the cartridges 80*a*, 80*b* to monitor concentration, fluid level, etc. The measuring techniques discussed above may be used with any of the embodiments discussed herein. Various sensors and measuring devices are disclosed in U.S. Pat. Nos. 4,222,497; 4,310,238 (Mochizuki et al.); 5,294,891 (Saklikar et al.); 5,447,056 (Foote) and PCT publications WO 94/01756 and WO94/01809.

The working solution reservoirs 52*a*, 52*b* preferably include agitators 107*a*, 107*b*. Overflow of working solution 54*a*, 54*b* from the development rolls 46*a*, 46*b* flows back into the respective working solution reservoirs 52*a*, 52*b*.

Controller 108 monitors the sensors 106*a*, 106*b*, 110*a*, 110*b* to determine if the ink solids concentration in the working solutions 54*a*, 54*b* is within an acceptable range and/or whether the level of working solution 54*a*, 54*b* in the reservoirs 52*a*, 52*b* is within a preferred range. The controller can either activate pumps 94*a*, 94*b* (to add additional ink concentrate 84*a*, 84*b*), activate pump 64 (to add additional liquid carrier to the working solutions 54*a*, 54*b*), or both. Overflow lines 98*a*, 98*b* allow excess working solutions 54*a*, 54*b* to drain into the second compartments 86*a*, 86*b* of the respective ink cartridges 80*a*, 80*b*. The overflow lines 98*a*, 98*b* provide a relatively constant maximum volume of working solution 54*a*, 54*b* in the working solution reservoirs 52*a*, 52*b*.

In one embodiment, once the first compartment 82*a* is empty, the controller 108 activates the working solution pump 102*a* and the valve 104*a* to direct the contents of the working solution reservoir 52*a* to the second compartment 86*a* of the removable cartridge 80*a*. The controller 108 can determine that the first compartment 82*a* is depleted by a variety of techniques, such as the sensor 112*a* (sensor 112*b* in cartridge 80*b*) or the inability to increase the concentration of ink solids in the working solution 54*a* after a predetermined number of attempts. In another embodiment, controller 108 counts the number of pixels of a given color that have been deposited on the photoreceptor material 50 during the development process. Total pixel count is correlated to ink solids consumption to estimate the life of the cartridges 80*a*, 80*b*. Pixel counting techniques are advantageous because they can predict when the cartridge 80*a*, 80*b* will be empty.

The present liquid replenishment system 40 provides a return system for capturing, storing, and recovering any overflow of working solution or liquid carrier from the working solution reservoir 52*a*. Additionally, the contents of the liquid carrier can be removed using a removable cartridge 60 or can be emptied into the working solution reservoir 52*a* and subsequently pumped using the working solution pump 102*a* into the second compartments 86*a* of the removable ink cartridge 80*a*. Upon completion of the ink replenishment cycle, the depleted ink cartridge 80*a* containing the printed down ink and/or used carrier is ejected from the electrographic imaging device 42 for refilling, replenishment and/or recycling. The same procedure can be applied to the other ink cartridges 80*b*, 80*c*, 80*d*.

The liquid replenishment system 40 of FIG. 3 also permits the second compartments 86*a*, 86*b* of the ink cartridge 80*a*, 80*b* to store the working solution 54*a*, 54*b* upon special circumstances, such as electrographic imaging device shutdown, servicing, moving, shipping, and/or other conditions, for which it is desirable to have all ink-related fluids removed from the electrographic imaging device 42. The working solution 54*a*, 54*b* can later be returned to the working solution reservoirs 52*a*, 52*b* through the working solution supply lines 92*a*, 92*b*. In addition, it provides a method of recovering such fluids for reuse upon normal electrographic imaging device start-up following such circumstances. The second compartments 86*a*, 86*b* may also be used for storing the working solution in cases such as normal shutdown, power save, or a sleep mode.

In another embodiment, the first compartments 82*a*, 82*b* contain the ink concentrate 84*a*, 84*b* and the second compartments 86*a*, 86*b* contain working solution 54*a*, 54*b*. The working solution 54*a*, 54*b* is pumped to the respective working solution reservoir 52*a*, 52*b*. As discussed above, printed down ink can be deposited in the now empty second compartments 86*a*, 86*b* for recycling. Concentrate 84*a*, 84*b* and/or liquid carrier 61 can be added during operation of the imaging device to maintain the working solution concentration. In this embodiment, the liquid carrier reservoir 60 is preferably a removable cartridge.

Figure 4:
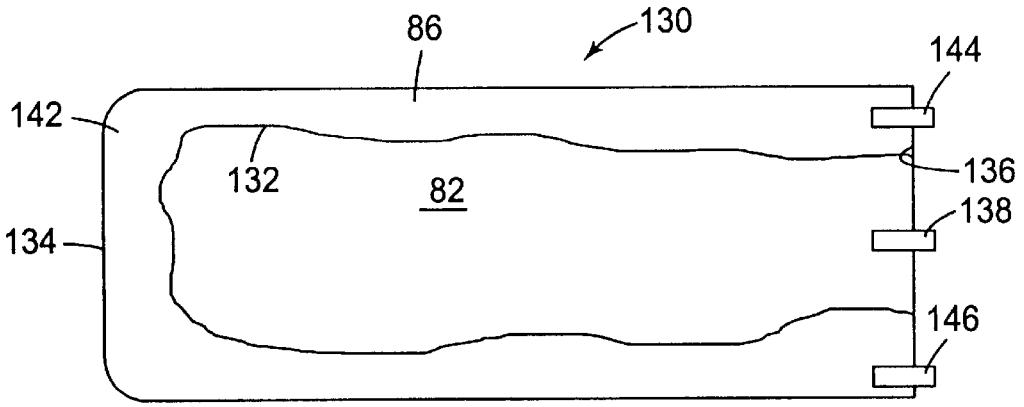
FIG. 4 is a side sectional view of an two compartment ink cartridge in accordance with the present invention.

FIG. 4 is a schematic illustration of an exemplary two-compartment ink cartridge 130 in which the first compartment 82 is defined by a collapsible container 132, such as a polymeric bag. The second compartment 86 is defined by the volume between the flexible container 132 and the outer container 134. As the contents of the first compartment 82 are removed from the cartridge 130, the relative size of the first compartment 82 decreases in proportion to the increase in the volume of second compartment 86. The container 132 is attached to an inside surface 136 in fluid communication with a valve port 138. Various methods can be used to ensure that the container 132 collapses from the rear 142 towards the valve port 138, such as the use of an elastomeric bag or orienting the cartridge so that the valve port 132 is at a lower elevation. Valves 138, 146 are fluidly connected to the ink carrier supply line 92. Valve 144 is fluidly connected to the return line 100.

Figure 5:
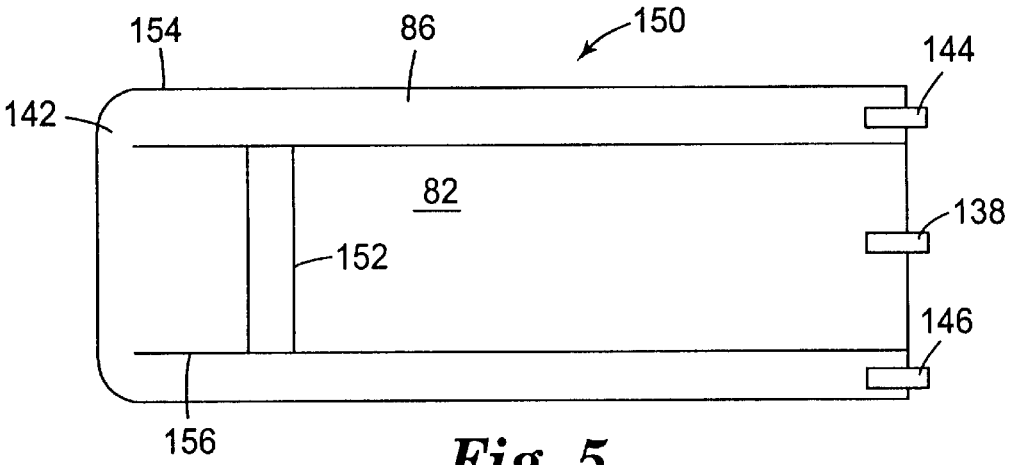
FIG. 5 is a side sectional view of an alternate two compartment ink cartridge in accordance with the present invention.

FIG. 5 is an alternate two-compartment ink cartridge 150 having a piston 152 that separates the first compartment 82 from the second compartment 86. The piston 152 is moved by the flow of the fluids in the cartridge 150 during electrographic imaging device operation. As discussed in connection with FIG. 4, the piston 152 keeps the contents of the first compartment 82 near the valve 138. Valves 138, 146 are fluidly connected to an ink carrier supply line 92. Valve 144 is fluidly connected to a return line 100. Alternatively, the piston 152 could be driven in a variety of ways, including by the pressure difference (pneumatic or vacuum from pumping of the ink concentrate), a screw drive, an actuator rod, or other external forces such as a spring. The piston 152 can either ride against an inside surface of the container 154 or along an optional inner cylinder 156. Use of the optional inner cylinder 156 allows the container 154 to have a non-uniform profile.

Figure 6:
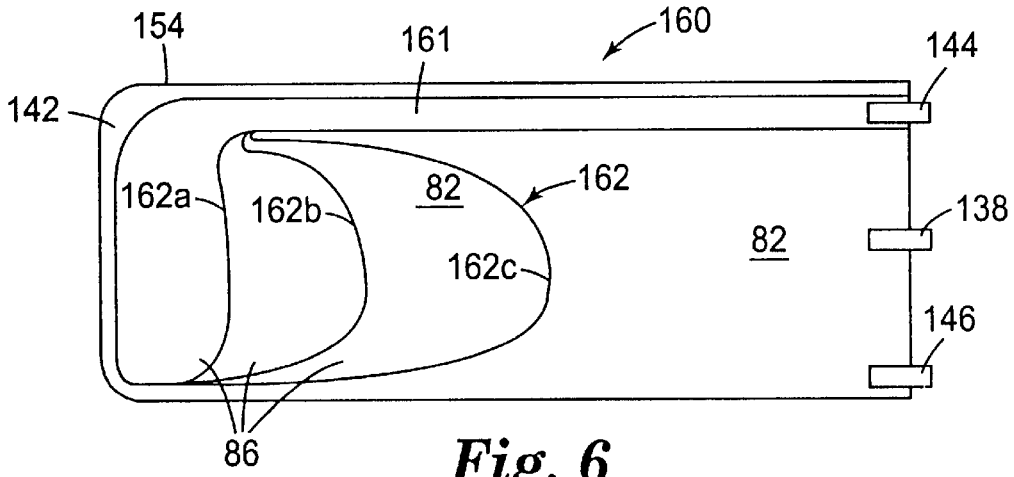
FIG. 6 is a side sectional view of another alternate two compartment ink cartridge in accordance with the present invention.

FIG. 6 illustrates an alternate two-compartment ink cartridge 160 utilizing an elastic or plastic membrane 162 to separate the first compartment 82 from the second compartment 86. Tube 161 ensures that the membrane 162 will expand from the rear of the cartridge 163 toward the valves 144, 146. The reference numerals 162*a*, 162*b*, 162*c* correspond to the elastic membrane 162 of FIG. 6 in various stages of inflation/deflation. The first compartment 82 is connected to the valve 138. Valve 146 is optionally connected to an ink carrier supply line 92. Valve 144 is fluidly connected to a return line 100.

Figure 7:
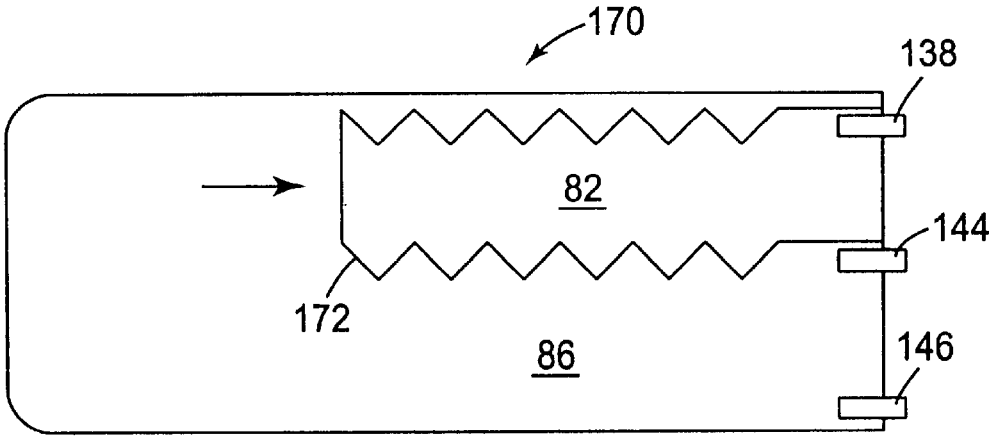
FIG. 7 is a side sectional view of another alternate two compartment ink cartridge in accordance with the present invention.

FIG. 7 is another embodiment of a two-compartment ink cartridge 170 utilizing an expandable plastic or elastomeric container 172 to define the first compartment 82. The volume of the second compartment 86 grows as the volume of ink concentrate decreases from the first compartment 82, thus enabling it to accept increasing amounts of printed down ink from the electrographic imaging device 42. The embodiments of FIGS. 4–7 allow for a proportional change in the size of the compartments 82, 86.

Single Compartment Ink Cartridge

Figure 8:
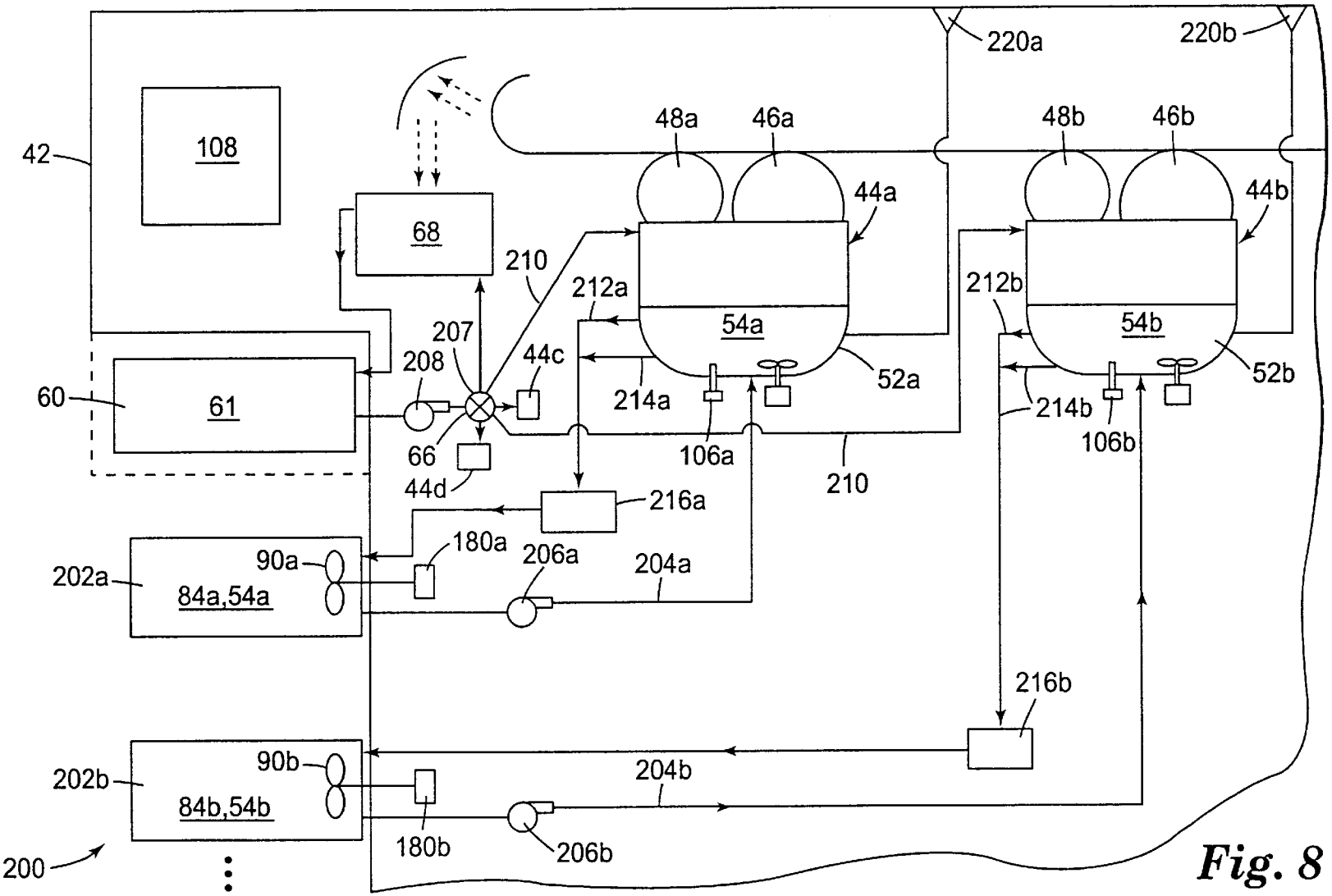
FIG. 8 is a schematic illustration of an ink replenishment system utilizing a one compartment ink cartridge for an electrographic imaging device in accordance with the present invention.

FIG. 8 is a schematic illustration of an alternate liquid replenishment system 200 for use with single compartment ink cartridges 202*a*, 202*b*. In a first embodiment, ink concentrate 84*a*, 84*b* is delivered to the working solution reservoirs 52*a*, 52*b* through an ink supply lines 204*a*, 204*b* by pumps 206*a*, 206*b*. The working solution reservoirs 52*a*, 52*b* may or may not be attached to the associated developer stations 44*a*, 44*b*. The working solution 54*a*, 54*b* can be advanced to the developer rolls 46*a*, 46*b* by various pump mechanisms (not shown). Carrier supply pump 208 and carrier supply lines 210 supply liquid carrier 61 from the cartridge 60 to the working solution reservoirs 52*a*, 52*b* and the condenser 68. The liquid carrier supply lines 210 are preferably positioned by the rolls 46*a*, 46*b*, 48*a*, 48*b* to facilitate cleaning.

Overflow lines 212*a*, 212*b* and return lines 214*a*, 214*b* fluidly couple the working solution reservoirs 52*a*, 52*b* to respective staging tanks 216*a*, 216*b* to hold printing fluids until the ink cartridges 202*a*, 202*b* are empty. Agitators 90*a*, 90*b* are preferably provided in the cartridges 202*a*, 202*b*. Actuators 180*a*, 180*b* are preferably positioned on the electrographic imaging device 42 to releasably couple to the agitators 90*a*, 90*b* (see generally FIG. 13).

Sensors 106*a*, 106*b* communicate the concentration of ink solids of the working solutions 54*a*, 54*b* to the controller 108. The controller 108 can activate one or more of the ink supply pumps 206*a*, 206*b* to increase the concentration of ink solids in the working solutions 54*a*, 54*b*. Alternatively, the controller 108 can activate the liquid carrier supply pump 208 to add liquid carrier, thereby decreasing the concentration of ink solids in the working solution 54*a*, 54*b*. Solenoid valve 207 permits liquid carrier to be selectively delivered to one or more of the developer stations 44*a*, 44*b*, 44*c*, 44*d*. Overflow lines 212*a*, 212*b* maintain a generally constant maximum volume in the working solution reservoirs 52*a*, 52*b*. When ink cartridges 202*a*, 202*b* are empty, the contents of the respective staging tanks 216*a*, 216*b* are emptied into the cartridges 202*a*, 202*b* for recycling. In the preferred embodiment, there are separate staging tanks fluidly coupled to each of the developer stations 44*a*, 44*b*, 44*c*, 44*d*, rather than a central staging tank for all developer stations.

In an alternate embodiment, overflow or drainage from the working solution reservoirs 52*a*, 52*b* goes directly back into the respective ink cartridges 202*a*, 202*b*. The ink concentrate 84*a*, 84*b* preferably has a low free charge of preferably less than 60%, more preferably less than 40%, and most preferably less than 30%. Free charge is measured as a ratio of the conductivity of the liquid carrier as it appears in the liquid ink and the conductivity of the liquid ink as a whole. See U.S. Pat. No. 5,652,282. Therefore, when the overflow ink or printed down ink flows back into the cartridges 202*a*, 202*b*, minimal free charge is being added to the concentrate 84*a*, 84*b*. Consequently, the printed down ink does not have to be kept separate from the ink concentrate 84*a*, 84*b*. As the printed down ink flows into the cartridges 202*a*, 202*b*, the concentration of the ink in the ink cartridges 202*a*, 202*b* is likely to decrease. When the controller 108 determines that one or more of the ink cartridges 202*a*, 202*b* are exhausted, the cartridges 202*a*, 202*b* are removed for recycling. Alternatively, the printed down ink can be sent to a removable container (not shown) for removal and/or recycling.

In yet another embodiment, working solution 54*a*, 54*b* (or ink concentrate) is supplied to the working solution reservoirs 52*a*, 52*b* through fill ports 220*a*, 220*b*. Liquid carrier 61 can be added to the working solution reservoirs 52*a*, 52*b* as required. In one embodiment, the electrographic imaging device 42 does not contain a replenishment system for replenishing the working solution 54*a*, 54*b*. The empty cartridges 202*a*, 202*b* (that previously contained the working solutions) are then attached to the electrographic imaging device 42 at the location of the ink cartridges 202*a*, 202*b*. When the controller 108 determines via sensors 106*a*, 106*b* that the concentration of one of the working solutions 52 is below a predetermined level, that working solution is drained into the respective container 202 for removal and recycling. Alternatively, waste container can be used in place of the empty cartridges 202*a*, 202*b*. In this embodiment, the ink supply lines 204 and ink supply pumps 206 are not required.

In yet another embodiment, the cartridges 202*a*, 202*b* initially contain working solution 54*a*, 54*b* before being attached to the electrographic imaging device 42. The working solution 54*a*, 54*b* is pumped directly to the developer rolls 46*a*, 46*b*. Overflow drains directly back into the cartridges 202*a*, 202*b* through return lines 214*a*, 214*b*. No working solution reservoirs 52*a*, 52*b* or staging tanks 216*a*, 216*b* are required. Additional liquid carrier 61 can be added to the cartridges 202*a*, 202*b* through the return lines 214*a*, 214*b*. No source of concentrate 84*a*, 84*b* is provided.

Figure 9:
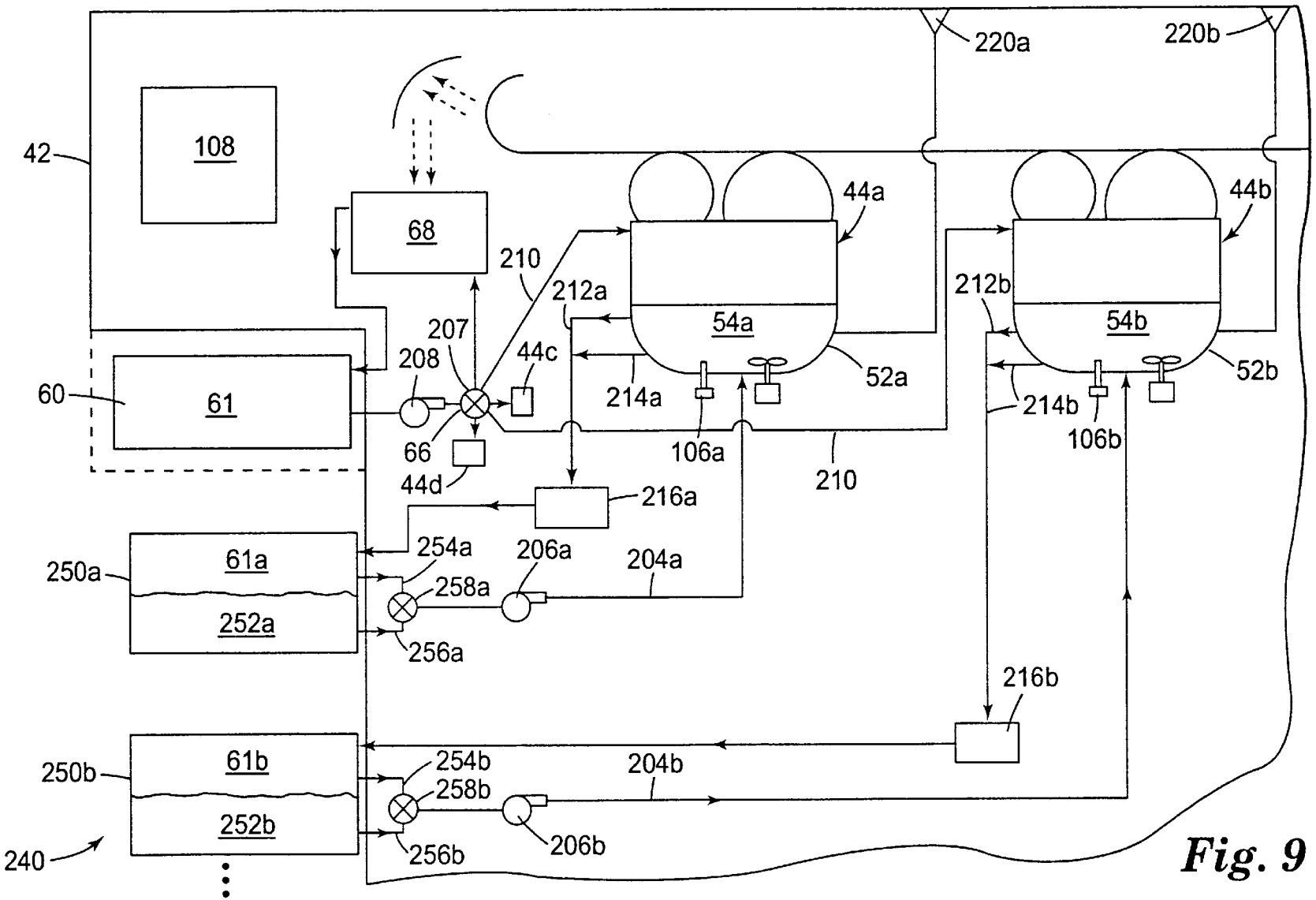
FIG. 9 is a schematic illustration of an alternate ink replenishment system utilizing a one compartment ink cartridge for an electrographic imaging device in accordance with the present invention.

FIG. 9 illustrates an alternate ink replenishment system 240 (generally shown in FIG. 8) that would be used with gel inks, such as disclosed in U.S. Pat. No. 5,652,282. Initially, the ink is mixed and could be immediately used. Over time, the ink solids will substantially separate from the liquid carrier 61*a*, 61*b* and form a gel layer 252*a*, 252*b*. The gel layer 252*a*, 252*b* will have a substantially higher ink solids concentration than the original ink. The liquid carrier layer 61*a*, 61*b* will be substantially free of ink solids, but may contain charge directors. The liquid carrier 61*a*, 61*b* can optionally be pumped to a liquid carrier reservoir 60. The liquid carrier reservoir 60 may either be permanent or a removable cartridge.

The time required for the separation of the gelled ink concentrate from the liquid carrier will vary between about 30 minutes and about 72 hours, depending upon the formulation of the ink. Liquid carrier supply lines 254*a*, 254*b* are positioned to supply liquid carrier 61*a*, 61*b* from the cartridges 250*a*, 250*b* to the respective working solution reservoirs 52*a*, 52*b*. Separate ink solids supply lines 256*a*, 256*b* are positioned to supply gelled ink concentrate from the cartridges 250*a*, 250*b* to the respective working solution reservoirs 52*a*, 52*b*. Valves 258*a*, 258*b* allow the controller 108 to select either liquid carrier 61*a*, 61*b* or gelled ink concentrate 252*a*, 252*b* to be pumped to the working solution reservoirs 52*a*, 52*b*. In one embodiment, printed down ink is retained in staging tanks 216*a*, 216*b* so as to not contaminate the liquid carrier 61*a*, 61*b* in the ink cartridges 250*a*, 250*b*. When the working solution 54*a*, 54*b* is exhausted, the printed down ink in the staging tanks 216*a*, 216*b* is returned to the cartridges 202*a*, 202*b* for removal and recycling.

Three-Compartment Ink Cartridge

Figure 10:
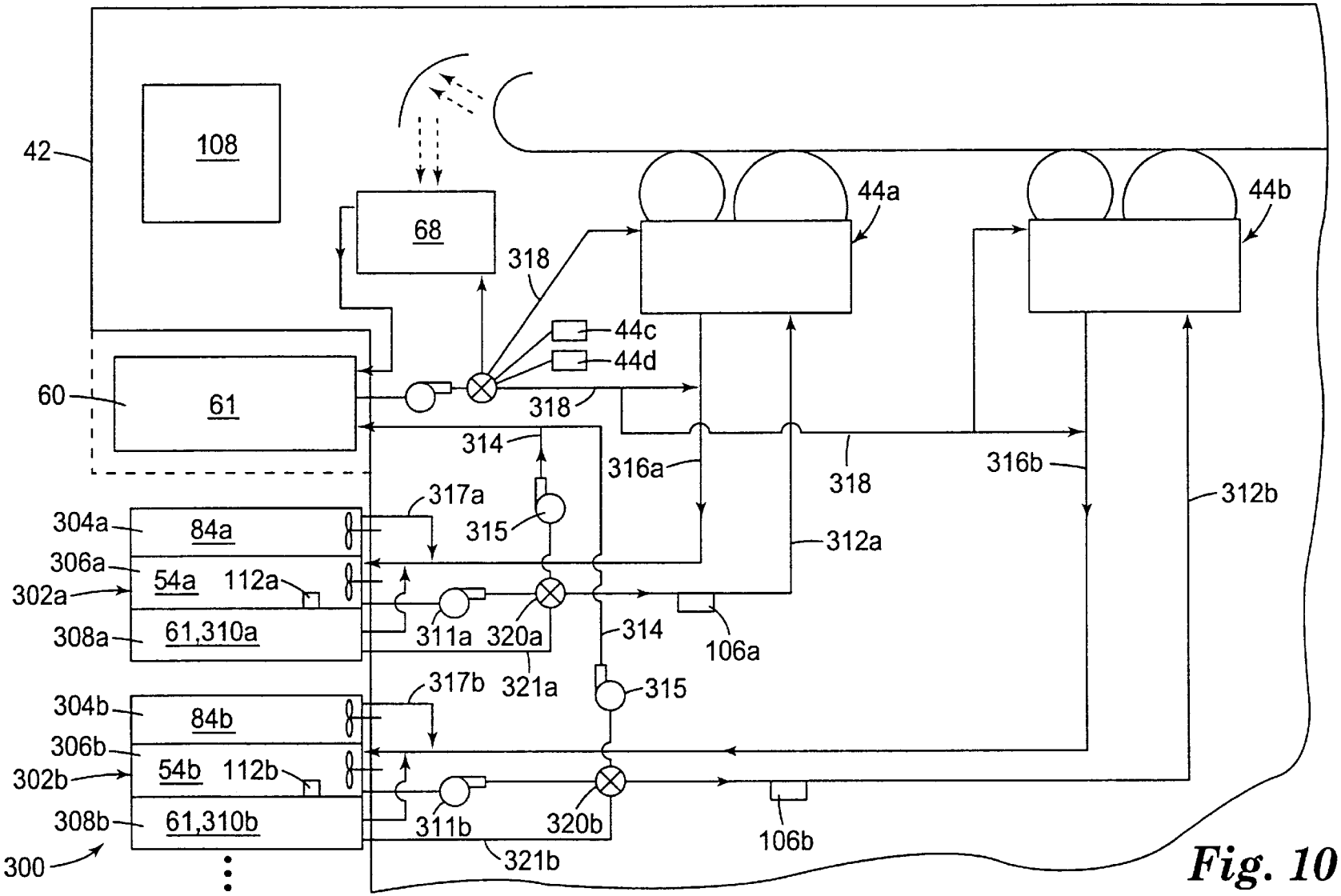
FIG. 10 is a schematic illustration of an ink replenishment system utilizing a three compartment ink cartridge for an electrographic imaging device in accordance with the present invention.

FIG. 10 is a schematic illustration of an ink replenishment system 300 utilizing three-compartment ink cartridges 302*a*, 302*b*. In one version of the embodiment of FIG. 10, the developer stations 44*a*, 44*b* do not include a working solution reservoirs, such as discussed below. Rather, one or more compartments of the ink cartridges 302*a*, 302*b* operate as working solution reservoirs.

In one embodiment, compartments 304*a*, 304*b* initially hold ink concentrate 84*a*, 84*b*, compartments 306*a*, 306*b* hold working solutions 54*a*, 54*b*, and compartments 308*a*, 308*b* hold liquid carrier 61. In the illustrated embodiment, the working solutions 54*a*, 54*b* have a greater concentration of charge carrier than the ink concentrate 84*a*, 84*b*. Working solution supply lines 312*a*, 312*b* and pumps 311*a*, 311*b* direct the working solutions 54*a*, 54*b* to the respective developer stations 44*a*, 44*b*. The liquid carrier 61 initially in compartments 308*a*, 308*b* is pumped to the liquid carrier cartridge 60 by a liquid carrier reservoir fill lines 314 and pumps 315. Once empty, the compartments 308*a*, 308*b* can be used for receiving printed down ink 310*a*, 310*b*. As will be discussed below with regard to the various embodiments, the compartments 306*a*, 306*b*, 308*a*, 308*b* may initially be used for other functions.

The concentration of the working solution 54*a*, 54*b* in the working solution compartments 306*a*, 306*b* can be measured by sensors 112*a*, 112*b*. Alternatively, sensors 106*a*, 106*b* in lines 312*a*, 312*b* can monitor the concentration of the working solution 54*a*, 54*b* delivered to the developer stations 44*a*, 44*b*. When the concentration of the working solutions 54*a*, 54*b* are not within established parameters, the controller 108 may add liquid carrier 61 through the liquid carrier supply lines 318 to the working solution reservoirs 306*a*, 306*b*. Alternatively, additional ink concentrates 84*a*, 84*b* from the compartments 304*a*, 304*b* can be added to the working solution reservoirs 306*a*, 306*b* through lines 317*a*, 317*b*. If there is insufficient volume in the compartments 306*a*, 306*b*, the solenoid valves 320*a*, 320*b* can direct a portion of the working solutions 54*a*, 54*b* to the compartments 308*a*, 308*b* through the lines 321*a*, 321*b* prior to the addition of ink concentrates 84*a*, 84*b* or liquid carrier 61 to the respective compartments 306*a*, 306*b*. Overflow from the developer stations 44*a*, 44*b* is directed through overflow lines 316*a*, 316*b* to the respective working solution compartments 306*a*, 306*b*. The overflow lines 316*a*, 316*b* can optionally include staging tanks, such as illustrated in FIG. 8.

The first embodiment of FIG. 10 has the advantage that the process of replenishing, circulating, and disposing of ink and liquid carrier is performed substantially within the ink cartridges 302*a*, 302*b*. The ink cartridges 302*a*, 302*b* can be ejected and reinserted at generally any time during the printing process with minimal disruption to the fluid management algorithms or the electrographic imaging device's fluid "housekeeping" (managing depleted ink and liquid staging). Additionally, the ink cartridges 302*a*, 302*b* can be ejected quicker once the ink concentrate 84*a*, 84*b* is depleted because less fluid needs to be transferred to the compartments 308*a*, 308*b*. The developer stations 44*a*, 44*b* do not require working solution reservoirs. Finally, the fluids in the various compartments 304, 306, 308 can have differing levels of charge carriers.

In yet another embodiment, the compartments 306*a*, 306*b* initially contain liquid carrier 61 that is pumped to the liquid carrier cartridge 60 by a liquid carrier reservoir fill lines 314 and pumps 311. The compartments 308*a*, 308*b* are initially empty so that they are immediately ready to receive printed down ink 310*a*, 310*b*. Working solution 54*a*, 54*b* is mixed in the compartments 306*a*, 306*b* by combining ink concentrate 84*a*, 84*b* from the compartments 304*a*, 304*b* and liquid carrier 61 from the liquid carrier cartridge 60 through the lines 316*a*, 316*b*. As discussed above, the developer stations 44*a*, 44*b* may or may not have a working solution reservoir, since the compartments 306*a*, 306*b* serve as a working solution reservoirs 54*a*, 54*b*.

Two-Compartment Ink Cartridge

Figure 11:
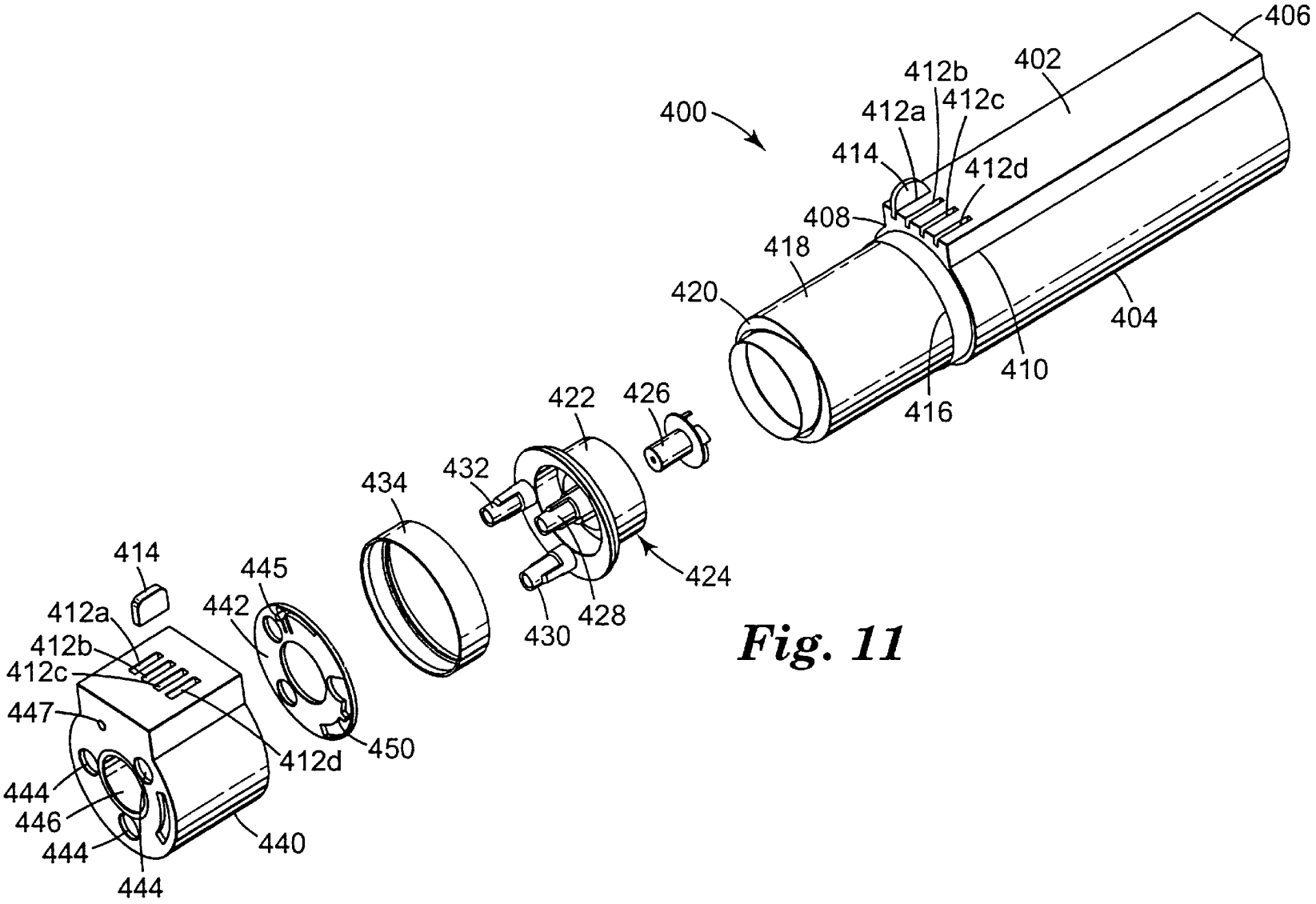
FIG. 11 is an exploded perspective view of an ink cartridge design in accordance with the present invention.

FIG. 11 is an exploded perspective view of an exemplary two-compartment ink cartridge 400 according to the present invention. In the illustrated embodiment, outer shell 402 is a unitary structure defining a continuous internal volume. The outer shell 402 has a primary portion 404 and a secondary portion 406. The secondary portion 406 assists in aligning the cartridge within the imaging device 42. In one embodiment, the secondary portion 406 includes a plurality of slots 412*a*, 412*b*, 412*c*, 412*d* for receiving a color key tab 414. As will be discussed below, the color key tab 414 can be used for a variety of functions, such as identifying the cartridge, preventing misalignment and improper insertion.

The outer shell 402 has a primary opening 416 for receiving internal container 418 to define multiple compartments. In the illustrated embodiment, the internal container 418 is a flexible bag. The internal container 418 has an opening 420 configured to attach to a flange 422 on seal disk assembly 424. The volume defined by the internal container 418 comprises the first compartment. The volume defined between the internal container 418 and the outer shell 402 comprises the second compartment.

Figure 13:
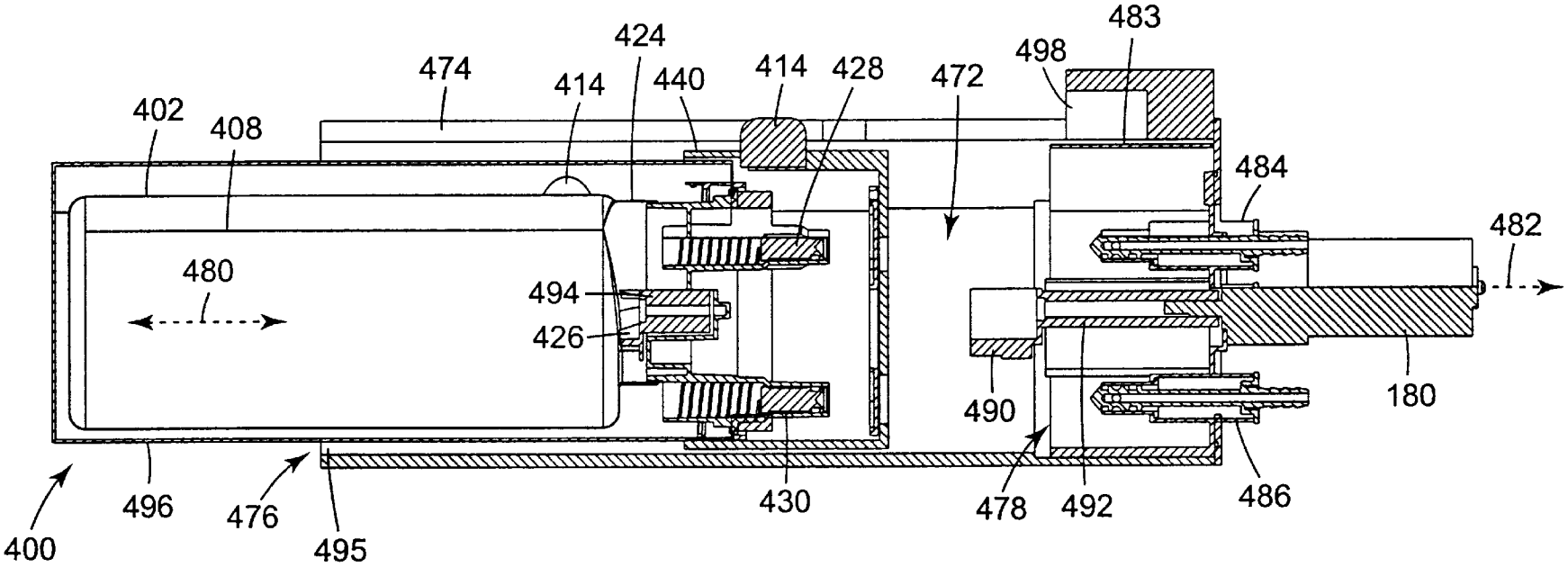
FIG. 13 is a sectional view of one embodiment of an ink cartridge and a cartridge assembly interface.

Seal disk assembly 424 has a recess (see FIG. 14) for receiving an impeller 426. As will be discussed below, the impeller 426 is preferably magnetically coupled to an actuator on the electrographic imaging device to provide agitation. Alternatively, a direct mechanical coupling may be used. Seal disk assembly 424 has three valve ports 428, 430, 432, each of which preferably include a valve, such as illustrated in FIG. 13. The valve ports are further described in commonly assigned patent application entitled Valve Assembly for Ink Cartridge (docket No. 53745USA3A) filed on the same date herewith. Valve port 428 fluidly communicates with the first compartment defined by the internal container 418. Valve ports 430 and 432 fluidly communicate with the second compartment. Valve port 430 is for receiving printed down ink. Valve port 432 is for supplying the contents of the second compartment (i.e., liquid carrier) to the electrographic imaging device 42. Closure device 434 retains the seal disk 424 to the outer shell 402.

Cap 440 extends over the seal disk assembly 424. The cap 440 has a series of holes 444 through which the ports 428, 430, 432 can be accessed, a valve access door 442, and a center hole 446 for interfacing actuator 180 with the impeller 426 (see FIG. 13). In an alternate embodiment, slots 412*a*, 412*b*, 412*c*, 412*d* are formed on the cap 440 for receiving a color key tab 414.

The valve access door 442 limits access to ports 428, 430, 432 (see FIG. 11) until the cartridge 400 is inserted onto the electrographic imaging device 42. The valve access door 442 is normally closed when the cartridge 400 is outside the electrographic imaging device 42. When in this position, the valve access door 442 is locked shut by a latch 445 that is captured by a latch retainer 447 on the cap 440.

When the cartridge 400 is inserted, a latch release key 448 located on the electrographic imaging device 42 releases the latch 445 from the latch retainer 447. At this point, a cam follower 450 on the valve access door 442 lines up with a cam 452 located on the electrographic imaging device 42. As the ink cartridge 400 is inserted into the electrographic imaging device 42, the cam follower 450 moves down cam 452 (see FIG. 15). Since the cam 452 is fixed on the electrographic imaging device, the valve access door 442 rotates as the cam follower 450 on the door 442 moves along the cam 452. Eventually, the valve access door 442 is completely opened and the ports 428, 430, 432 can be engaged with the electrographic imaging device 42. When the ink cartridge 400 is ejected, the ports 428, 430, 432 disengage and the cam follower 450 on the valve access door 442 moves along the cam 452 until the valve access door 442 is in the closed position. Once the door 442 reaches a closed position, the latch 445 engages with the latch retainer 447, locking the door 442 into position over the ports 428, 430, 432. In another embodiment, the latch release key 448 is omitted. The latch 445 and latch retainer 447 comprises a detent system that is overcome by the force generated by the cam 452.

FIG. 13 is a cross-sectional side view of an ink cartridge 400 generally as discussed above partially inserted into an ink cartridge bay 472 of a electrographic imaging device housing 474. At one end of the ink cartridge bay 472 is an opening 476 through which the ink cartridge 400 is inserted and removed. The opening 476 preferably has a shape corresponding to a cross section of the ink cartridge 400 (see FIG. 15) to facilitate the correct orientation. At the other end is a cartridge interface assembly 478 for fluidly coupling the ink cartridge 400 with the electrographic imaging device 42. The cartridge interface assembly 478 includes a shroud 483 for receiving cap 440 and valve ports 484, 486 and 488 (see FIG. 15) for fluidly coupling with the valve ports 428, 430, 432, respectively, on the ink cartridge 400. Each of the valve ports is preferably self sealing so as to prevent leakage from the ink cartridge 400 or the electrographic imaging device 42 when the cartridge 400 is removed.

Drive magnet 490 is coupled to the actuator 180 by shaft 492 positioned to magnetically couple with impeller magnet 494 to drive impeller 426. The impeller magnet 494 is preferably contained within the outer shell 402 to minimize leakage of ink. The drive magnet 490 preferably has a shape complementary to the shape of the impeller magnet 494. The magnetic coupling between the magnets 490, 494 is sufficient to transfer rotational energy to the impeller 426, but is easily decoupled when the ink cartridge 400 is removed from the electrographic imaging device 42.

The ink cartridge 400 has a longitudinal axis 480 that corresponds with longitudinal axis 482 on the cartridge interface assembly 478. As the ink cartridge 400 is advanced along longitudinal axis 480, the cap 440 is received by the shroud 483 and the magnets 490, 494 couple. The valve ports 428, 430, 432 and mating valve ports 484, 486, 488 are fully open when the ink cartridge 400 is fully engaged with the ink cartridge bay 472. Latch 495 optionally engages with edge 496 of the cartridge 400 to retain the cartridge in the ink cartridge bay 472.

Detector 498 is mounted in the ink cartridge bay 472 in a position to engage with the color key tab 414. The detector 498 can have a slot positioned to receive the color key tab 414 only if it is in the correct slot 412*a*, 412*b*, 412*c*, 412*d* on the outer shell 402. That is, the detector slot prevents cartridges of the wrong color from being fully inserted into the ink cartridge bay 472. The detector can include a switch that senses the presence of the color key tab 414, such as a mechanical switch or optical sensor. In another embodiment, the color key tab 414 includes a data storage device, such as a microchip with read/write capabilities or bar code, containing information about the ink cartridge 400, that can be read by the detector 498. The data storage device could include information about the color of the ink concentrate, concentration of the ink concentrate to liquid carrier, date the ink cartridge was manufactured, remaining life of the ink cartridge, number of prints made from the cartridge, and manufacturer identification codes.

Figure 14:
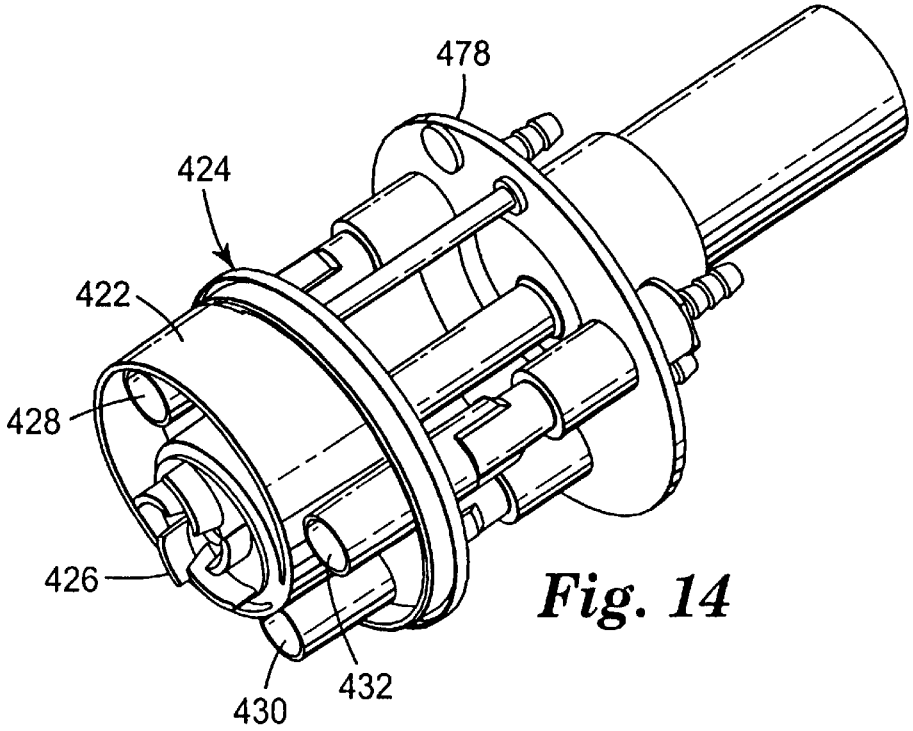
FIG. 14 is a perspective view of the cartridge assembly interface of FIG. 13.

FIG. 14 is a perspective view of the cartridge interface assembly 478 fully engaged with the disk seal assembly 424. The rear view of the disk seal assembly 424 illustrates the flange 422 for receiving the internal container 418 (see FIG. 11) surrounding the impeller 426 and rear side of valve port 428. The rear side of valve ports 430, 432 are positioned to fluidly couple with the region between the outer shell 402 and the internal container 418 (see FIG. 11).

Figure 15:
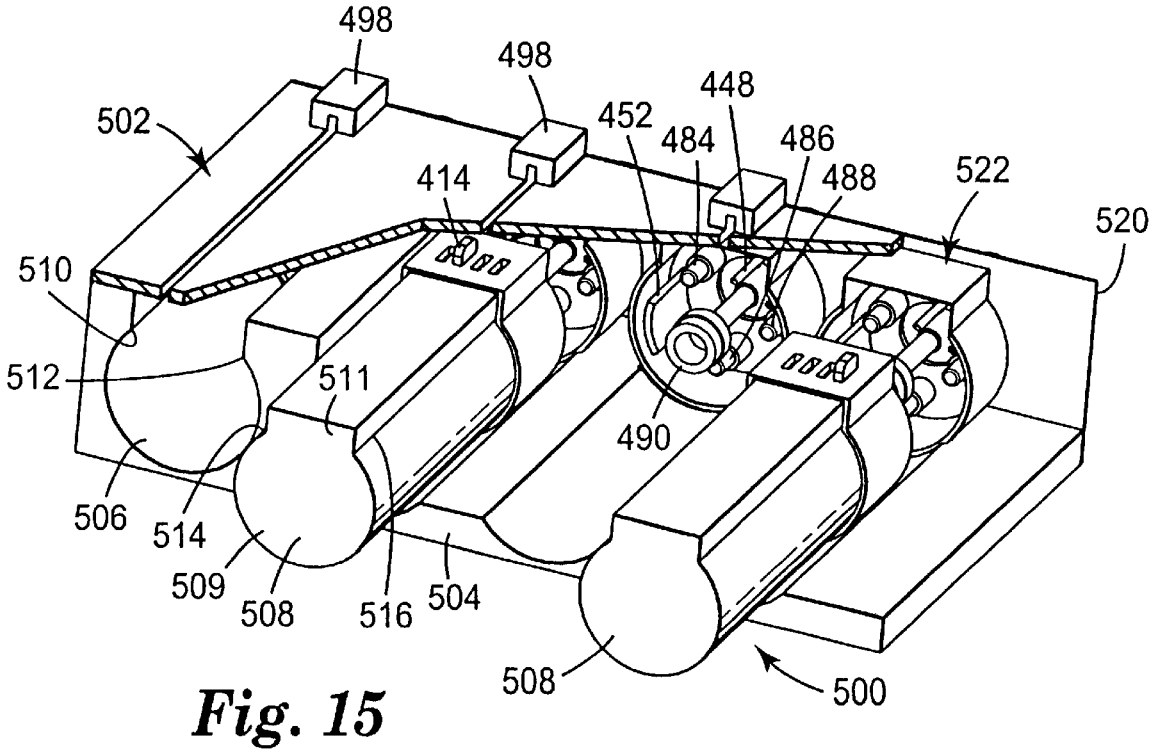
FIG. 15 is a perspective view of an ink cartridge bay in accordance with the present invention.

FIG. 15 is a perspective cut-away view of an ink cartridge bay 500 in accordance with the present invention. The ink cartridge bay 500 is typically located within the electrographic imaging device housing 502. The electrographic imaging device housing 502 includes a front panel 504 having a series of ink cartridge openings 506 that have a shape corresponding to a cross section of ink cartridges 508. In the illustrated embodiment, the opening 506 has a pair of opposing protrusions 510, 512 that correspond to the transition 514, 516 between primary portion 509 and secondary portion 511 on the ink cartridge 508, so that the ink cartridges 508 are properly oriented within the ink cartridge bay 500.

Figure 12:
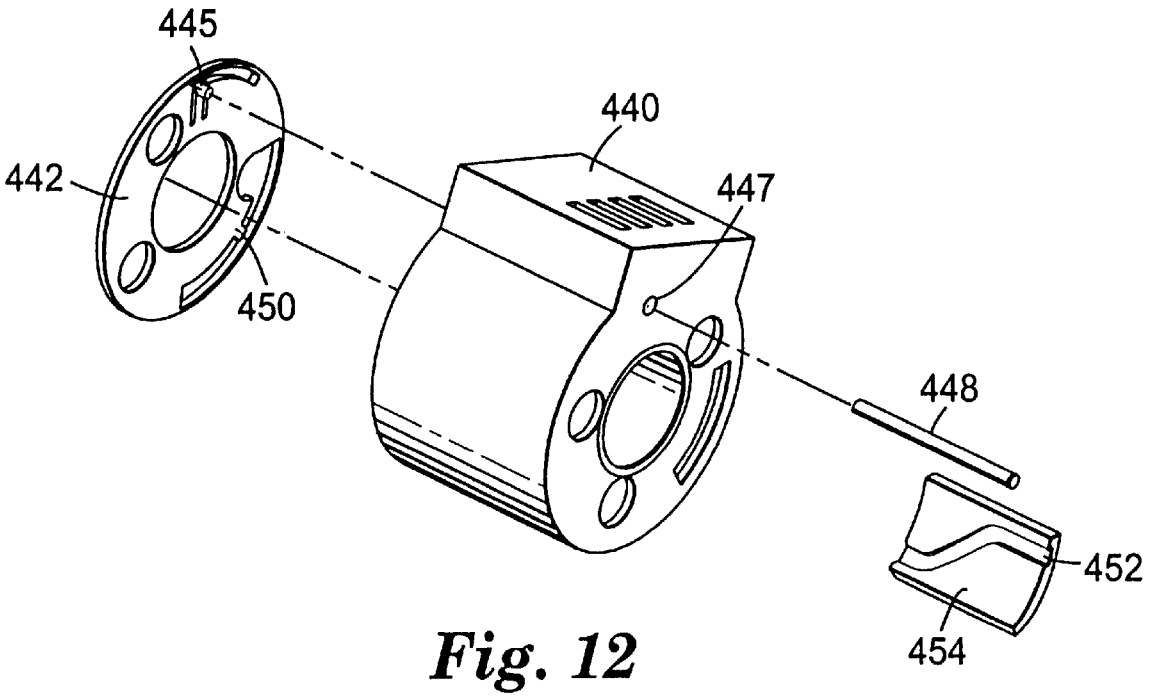
FIG. 12 is an exploded perspective view of an cap for an ink cartridge in accordance with the present invention.

Opposite the openings 506 at the far end of the ink cartridge bay 500 is a electrographic imaging device bulkhead 520 having a series of receptacle assemblies 522 positioned to engage with the ink cartridges 508 (see FIG. 13). In addition to the three mating valve ports 484, 486, 488 and drive magnet 490 discussed above, the receptacles 522 include the latch key release 448 and cam 452 illustrated in FIG. 12 to activate the valve access door 442. The sensor 498 is positioned to engage with the color key tab 414.

Liquid Ink

Liquid ink found particularly suitable for use in the present invention include gel organosols that exhibit excellent imaging characteristics in liquid immersion development. For example, the gel organosol inks exhibit low bulk conductivity, low free phase conductivity, low charge/mass and high mobility, all desirable characteristics for producing high resolution, background free images with high optical density. In particular, the low bulk conductivity, low free phase conductivity and low charge/mass of the inks allow them to achieve high developed optical density over a wide range of ink solids concentrations, thus improving their extended printing performance relative to conventional inks.

When used in electrophotography, these liquid inks on development form colored films which transmit incident radiation such as, for example, near infrared radiation, consequently allowing the photoconductor layer to discharge. In contrast, non-film forming inks comprising non-coalescent particles scatter a portion of the incident light. Non-coalesced ink particles therefore result in the decreasing of the sensitivity of the photoconductor to subsequent exposures and consequently there is interference with the overprinted image.

The liquid carrier is typically oleophilic, chemically stable under a variety of conditions, and electrically insulating. Electrically insulating means that the liquid carrier has a low dielectric constant and a high electrical resistivity. Preferably, the liquid carrier has a dielectric constant of less than 5, and still more preferably less than 3. Examples of suitable liquid carriers are aliphatic hydrocarbons (n-pentane, hexane, heptane and the like), cycloaliphatic hydrocarbons (cyclopentane, cyclohexane and the like), aromatic hydrocarbons (benzene, toluene, xylene and the like), halogenated hydrocarbon solvents (chlorinated alkanes, fluorinated alkanes, chlorofluorocarbons and the like), silicone oils and blends of these solvents.

Preferred liquid carriers include paraffinic solvent blends sold under the names Isopar G liquid, Isopar H liquid, Isopar K liquid and Isopar L liquid (manufactured by Exxon Chemical Corporation, Houston, Tex.). The preferred liquid carrier is Norpar-12 liquid, also available from Exxon Corporation.

The optimal weight ratio of resin to colorant in the toner particles is on the order of 1/1 to 20/1, most preferably between 10/1 and 3/1. The total dispersed "solid" material in the liquid carrier typically represents 0.5 to 20 weight percent, most preferably between 0.5 and 3 weight percent of the total liquid ink composition.

Inks for use in the present invention include a soluble charge control agent, sometimes referred to as a charge director, to provide uniform charge polarity of the toner particles. The charge director may be incorporated into the toner particles, may be chemically reacted to the toner particle, may be chemically or physically adsorbed onto the toner particle (resin or pigment), and may be chelated to a functional group incorporated into the toner particle, preferably via a functional group comprising the stabilizer. The charge director acts to impart an electrical charge of selected polarity (either positive or negative) to the toner particles. Any number of charge directors described in the art may be used herein; preferred positive charge directors are the metallic soaps. See U.S. Pat. No. 3,411,936, Rotsman et al. The preferred charge directors are polyvalent metal soaps of zirconium and aluminum, preferably zirconium octoate. Exemplary inks, liquid carriers, ink solids, and charge directors are described with more particularity in U.S. Pat. Nos. 5,652,282 and 5,698,616.

All patent and patent applications, including those disclosed in the background of the invention, are hereby incorporated by reference. The present invention has now been described with reference to several embodiments thereof. It will be apparent to those skilled in the art that many changes can be made in the embodiments described without departing from the scope of the invention. Thus, the scope of the present invention should not be limited to the structures described herein, but rather by the structures described by the language of the claims, and the equivalents of those structures.

What is claimed is:

1. A removable ink cartridge for an ink replenishment system adapted to engage with a cartridge interface assembly and a detector in an ink cartridge bay on an electrographic imaging device, the removable ink cartridge comprising:

an outer shell comprising at least a first compartment containing a liquid ink and a second compartment;

a first valve fluidly coupled to the first compartment;

second and third valves fluidly coupled to the second compartment, the first, second, and third valves being adapted to engage with corresponding valves at the cartridge interface assembly; and a plurality of key slots for receiving one or more key tabs that identify the ink cartridge, the key tabs being positioned to engage with the detector in the ink cartridge bay.

2. The ink cartridge of claim 1 wherein the outer shell comprises an asymmetrical cross section corresponding to a cross section of the ink cartridge bay.

3. The ink cartridge of claim 1 wherein a relative size of the first and second compartments changes dynamically.

4. The ink cartridge of claim 1 wherein the first compartment comprises a flexible container.

5. The ink cartridge of claim 1 wherein the one of the compartments comprises a working solution reservoir.

6. The ink cartridge of claim 1 wherein the liquid ink comprises working solution.

7. The ink cartridge of claim 1 wherein the liquid ink comprises ink concentrate.

8. The ink cartridge of claim 1 wherein the second compartment of the ink cartridge contains a fluid selected from the group consisting of liquid carrier, working solution, and charge director.

9. The ink cartridge of claim 1 further comprising a valve access door extending across the valves in a closed position, the valve access door being rotatable to an open position in response to engagement of the ink cartridge with the cartridge interface assembly.

10. The ink cartridge of claim 9 wherein the valve access door further comprises a latch for retaining the valve access door in the closed position.

11. The ink cartridge of claim 1 wherein the key slots are located on the outer shell.

12. The ink cartridge of claim 1 wherein the key slots are located on a cap extending across the valves.

13. The ink cartridge of claim 1 wherein the key tabs comprise a mechanical or electrical element.

14. The ink cartridge of claim 1 wherein the key tabs comprise a data storage device.

15. The ink cartridge of claim 1 wherein the key tabs identify the color of the liquid ink.

16. The ink cartridge of claim 1 wherein the key tabs communicate information to the electrographic printer selected from the group consisting of color of the ink, alignment of the ink cartridge with the cartridge interface assembly, concentration of the ink to liquid carrier, date the ink cartridge was manufactured, remaining life of the ink cartridge, number of prints made from the cartridge, and manufacturer identification codes.

17. The ink cartridge of claim 1 wherein the ink cartridges comprise three compartments.

18. The ink cartridge of claim 17 wherein the third compartment initially contains liquid carrier.

19. The ink cartridge of claim 17 wherein one of th e compartment comprises the working solution reservoir.

20. The ink cartridge of claim 17 wherein the relative size of at least two of the compartments changes dynamically.

21. The ink cartridge of claim 1 further comprising at least one sensor for monitoring a concentration and/or level of the working solution.

22. The ink cartridge of claim 1 wherein the removable ink cartridge is oriented generally horizontal within the electrographic imaging device.

23. The ink cartridge of claim 1 wherein the removable ink cartridge is oriented generally vertical within the electrographic imaging device.

24. The ink cartridge of claim 1 further comprising an impeller located within the first compartment adapted to magnetically couple with an actuator in the cartridge interface assembly.

25. A removable ink cartridge in a liquid replenishment system adapted to engage with a cartridge interface assembly in an ink cartridge bay on an electrographic imaging device, the removable ink cartridge comprising:

an outer shell comprising a compartment containing a liquid ink, the outer shell having an asymmetrical cross section configured to engage with a corresponding structure in the ink cartridge bay;

at least one valve fluidly coupled to the compartment, the at least one valve being adapted to engage with a corresponding valve at the cartridge interface assembly;

a plurality of key slots located on the removable ink cartridge for receiving one or more key tabs that identify the ink cartridge, the key tabs being positioned to engage with a corresponding detector in the ink cartridge bay;

an impeller located within the first compartment adapted to magnetically couple with an actuator in the cartridge interface assembly; and a valve access door extending across the valve in a closed position, the valve access door being rotatable to an open position in response to engagement of the ink cartridge with the cartridge interface assembly.

26. The ink cartridge of claim 25 wherein the liquid ink comprises working solution.

27. The ink cartridge of claim 25 wherein the liquid ink comprises ink concentrate.

28. The ink cartridge of claim 25 wherein the key tabs comprise a mechanical or electrical element.

29. The ink cartridge of claim 25 wherein the key tabs comprise a data storage device.

30. The ink cartridge of claim 25 wherein the key tabs communicate information to the electrographic printer selected from the group consisting of color of the ink, alignment of the ink cartridge with the cartridge interface assembly, concentration of the ink to liquid carrier, date the ink cartridge was manufactured, remaining life of the ink cartridge, number of prints made from the cartridge, and manufacturer identification codes.

31. A cap for a removable ink cartridge used in an ink replenishment system, the ink cartridge being adapted to engage with a cartridge interface assembly and a detector in an ink cartridge bay on an electrographic imaging device, the removable ink cartridge having at least a first compartment containing a liquid ink fluidly coupled to a first valve and a second compartment fluidly coupled to the second valve, the cap comprising:

a cap structure having a first opening for accessing the first valve and a second opening for accessing the second valve, the cap structure being adapted to extend over an end of the ink cartridge; and a plurality of key slots for receiving one or more key tabs that identify the ink cartridge, the key tabs being positioned to engage with the detector in the ink cartridge bay.

32. The cap of claim 31 wherein the ink cartridge includes an impeller located within the first compartment adapted to couple to an actuator at the cartridge interface assembly, cap structure further comprises an opening for coupling the impeller to the actuator.

33. The cap of claim 31 further comprising a valve access door extending across the first and second openings in a closed position, the valve access door being rotatable to an open position in response to engagement of the ink cartridge with the cartridge interface assembly.

34. The ink cartridge of claim 33 wherein the valve access door further comprises a latch for retaining the valve access door in the closed position.

* * * * *